US007461408B1

(12) United States Patent
Barkdoll

(10) Patent No.: US 7,461,408 B1
(45) Date of Patent: Dec. 9, 2008

(54) HEAD ORNAMENTATION

(76) Inventor: Gerald L. Barkdoll, 12314 Riding Fields Rd., Rockville, MD (US) 20850

( * ) Notice: Subject to any disclaimer, the term of this patent is extended or adjusted under 35 U.S.C. 154(b) by 296 days.

(21) Appl. No.: 11/246,886

(22) Filed: Oct. 7, 2005

(51) Int. Cl.
*A42B 3/00* (2006.01)

(52) U.S. Cl. ..... 2/209.13; 2/410; 2/6.2; 2/6.8; 2/422; 2/425; 2/10; 2/171

(58) Field of Classification Search ..... 2/410, 2/6.2, 6.8, 422, 10, 425, 171, 209.13
See application file for complete search history.

(56) References Cited

U.S. PATENT DOCUMENTS 1,244,559 A * 10/1917 Stocks ..... 2/6.8
2,958,156 A * 11/1960 Schmahl et al. ..... 446/27
3,182,422 A * 5/1965 Ryan ..... 446/27
3,399,486 A * 9/1968 Bogaart ..... 446/27
3,491,374 A * 1/1970 Frangos ..... 2/171.3
4,121,304 A 10/1978 Cooper
4,488,372 A * 12/1984 Lowen ..... 446/27
4,987,615 A 1/1991 Massey
5,088,127 A * 2/1992 Thornock ..... 2/209.13
5,465,427 A 11/1995 Shields
5,530,970 A * 7/1996 Knutson ..... 2/209.13
5,636,383 A * 6/1997 Cwiakala ..... 2/171
5,996,127 A * 12/1999 Leslie ..... 2/422
6,076,191 A 6/2000 Kapas
6,357,049 B1 3/2002 Hoffman
6,401,260 B1 6/2002 Porth
6,604,975 B1 8/2003 Yeh
2005/0097657 A1 5/2005 Porzio
2005/0262619 A1 * 12/2005 Musal et al. ..... 2/421

* cited by examiner

*Primary Examiner*—Gary L Welch
*Assistant Examiner*—Alissa J Tompkins
(74) *Attorney, Agent, or Firm*—Berenato, White & Stavish

(57) ABSTRACT

An improved head ornamentation such as a mask, cap, hat or headdress which is designed to be supported by a wearer's head and is moveable relatively thereto by the wearer's body movements or a mechanical device controlled by the wearer.

11 Claims, 2 Drawing Sheets

HEAD ORNAMENTATION

FIELD OF THE INVENTION

This invention relates in general to improvements in head ornamentations including but not limited to hats, caps, ornamental masks and headdresses, to move in accordance with the wearer's body movement or in accordance with a mechanical or electro-mechanical mechanism.

BACKGROUND OF THE INVENTION

Head ornamentations are used in a variety of festive occasions such as sporting events, Mardi Gras, Carnivals, parades, Halloween parties, and theatrical productions. While many such ornamentations are static, it is much more preferable to animate them so that they are more entertaining. For example, to animate an ornamental mask it must be attached to a stick and the hands must be used to hold and move it. Similarly, to animate a hat the hands must be used.

Accordingly, it would be very desirable for a person wearing a head ornamentation such as a mask or a hat to be able to cause the head ornamentation to move such as bobble (generally up and down), spin (rotate about an axis), and wobble (irregular side to side motion) through the simple body movements of the wearer, without the use of the wearer's hands. In this manner the wearer's hands could remain free to impart a more life-like movement to the character for such things as waving to an audience, clapping, or shaking hands along a parade route.

SUMMARY OF THE INVENTION

The present invention is directed at overcoming one or more of the problems or disadvantages associated with the relevant technology. As will be more readily understood and fully appreciated from the following detailed description of preferred embodiments of the present invention, the invention is embodied in an ornamentation which is designed to be supported by the wearer's head and is movable by the wearer's body movements or a mechanical device controlled by the wearer

DESCRIPTION OF THE DRAWINGS

Further objectives of the invention, together with additional features contributing thereto and advantages accruing therefrom, will be apparent from the following description of preferred embodiments of the invention which are shown in the accompanying drawings, wherein.

DETAILED DESCRIPTION OF A PREFERRED EMBODIMENT

Figure 1:
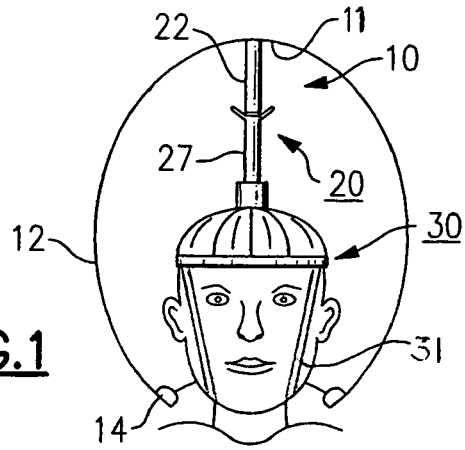
FIG. 1 is a frontal elevational view of a first embodiment of the invention positioned on a wearer with portions broken away to better illustrate the internal mechanism which effects the relative vertical movement between the ornamentation and the wearer.

Referring now to the drawings, wherein like numeral indicate corresponding like parts, there is illustrated various preferred embodiments of the improved head ornamentation of the present invention.

As best illustrated in FIG. 1, the head ornamentation 10 includes an outer shell 12 which is configured in any manner of a wearer's choosing to depict a character or whatever the ornamentation is to portray. The outer shell 12 is preferably designed to entirely cover the wearer's head, and to this end may be slightly or substantially larger than the head of the wearer. However, it is to be understood that the outer shell 12 may be configured in a manner which does not entirely cover the wearer's head, which will depend upon the particular visual impact the ornamentation is to present as desired by the wearer. The bottom of the outer shell 12 will preferably have an opening sufficient for the wearer to place the head ornamentation over his or her head, and the outer shell 12 may be formed as a single piece, or two or more pieces joined by suitable fasteners. It is preferable that the bottom edges 14 of the outer shell 12 be weighted to assure that the center of gravity of the head ornamentation and mechanism is below the interface of the two portions of a vertical support 20 which is described in detail hereinafter.

The vertical support 20 includes an upper portion 22 and a lower portion 27 into which the upper portion 22 telescopes, although it is to be understood that the lower portion 27 could be formed to telescope into the upper portion 22, if desired. In the embodiment illustrated in FIG. 1, the lower portion 27 is attached to a cap or head-strap configuration 30 that fits over and is secured to a wearer's head with the lower portion 27 of the vertical support 20 extending upwardly therefrom towards the interior of the outer shell 12. The cap or head-strap configuration may include an adjustment chin strap 31. The upper portion 22 of the vertical support 20 is secured to the inner surface 11 of the outer shell 12, and extends downwardly therefrom towards the wearer's head for engagement with the lower portion 27 of the vertical support 20.

Figure 2:
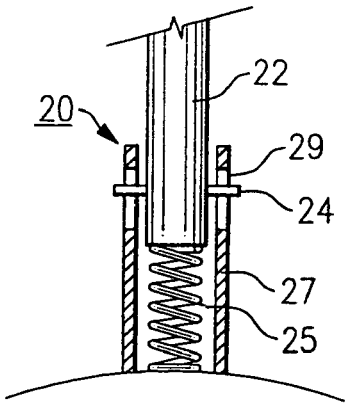
FIG. 2 is an enlarged view of a portion of the mechanism used in the embodiment illustrated in FIG. 1 to effect the relative vertical movement between the head ornamentation and the wearer.

A compression spring 25, of a size and spring rate which is dependent upon the size and weight of the outer shell 12, is carried within the lower portion 27 of the vertical support 20 to effect "hands free" relative vertical movement between the head ornamentation 10 and the wearer. As best illustrated in FIG. 2, the coiled compression spring 25 is carried within the lower portion 27 and provides an upwardly directed biasing force permitting the outer shell 12 to bob up and down when the wearer moves his or her body up and down. The outer shell 12 will remain bobbing and/or moving for a period of time which is dependent on the oscillation decay rate of the spring 25 and the spacing or "play" between the upper and lower portions of the vertical support.

To limit the separation between the upper and lower portions 22 and 27, respectively, during the bobbing motion, the upper portion 22 includes a pin 24 extending through or from a distal end thereof. The pin 24 is positioned on the upper portion 22 to engage with a slot 29 formed in the distal end of the lower portion 27. In this manner the relative vertical movement between the two portions 22 and 27 of the vertical support 20 is limited to the length of the slot 29 which functions to retain the two portions together under the upward biasing force of the compression spring 25.

Figure 5:
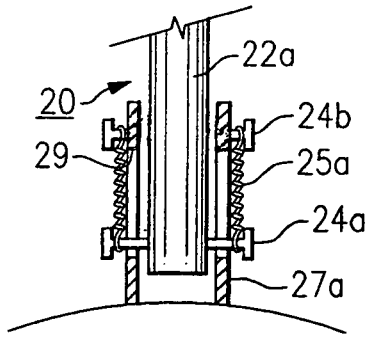
FIG. 5 is an enlarged view of an alternative base portion of the mechanism used in the embodiment illustrated in FIG. 1 to effect the relative vertical movement between the head ornamentation and the wearer.

As an alternate embodiment to the compression-spring-activated design previously described, a lower portion 27*a* of the vertical support 20 may be constructed in the manner illustrated in FIG. 5. In this embodiment a pair of pins 24*a* are connected near the open distal end of the lower portion 27*a* of the vertical support 20, and a pair of tension springs or rubber bands 25*a* are utilized to couple pins 24*b* connected near the distal end of the upper portion 22*a* to the pins 24*a* of the lower portion 27*a* for effecting an upward biasing force against the outer shell 12.

Figure 3:
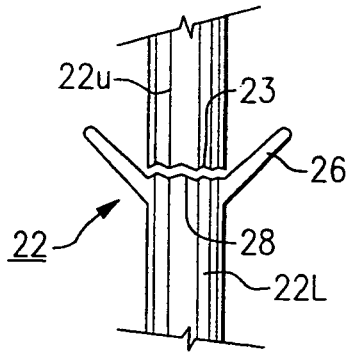
FIG. 3 is an enlarged view of another mechanism for use in the embodiment illustrated in FIG. 1 to effect the relative rotational and side to side movement between the head ornamentation and the wearer.
Figure 4:
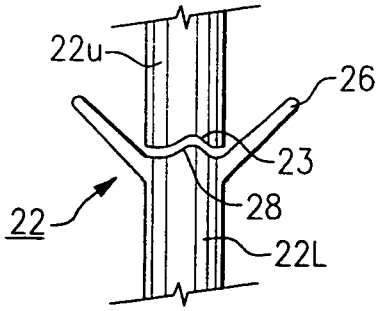
FIG. 4 is an enlarged view of an alternative mechanism to that illustrated in FIG. 3 for use in the embodiment illustrated in FIG. 1 to effect the relative rotational and side to side movement between the head ornamentation and the wearer.

As best illustrated in FIGS. 3 and 4, the upper portion 22 may also be divided into two sections, 22*u* and 22L. The bottom surface of the upper section 22*u* of the upper portion 22 may be formed with or support teeth 23 to engage and mesh with complementary formed teeth 28 formed on or supported by an upper surface of the lower section 22L of the upper portion 22. In this manner the engagement of the two sets of teeth 23 and 28 will prevent the outer shell 12 from turning until acted upon by movement of the wearer. By body movement, the wearer can cause the outer shell 12 to bob upwardly, causing the teeth 23 and 28 to move out from engagement with each other, while turning the body relative to the outer shell 12 to thereby effect a rotational movement between the outer shell 12 and the wearer's body. The shape and size of the meshing protrusions or teeth 23 and 28 can be varied, as illustrated in FIGS. 3 and 4, to change the amount of effort required to implement rotation or the speed and extent of the resulting rotation. As illustrated in FIGS. 3 and 4, the upper end of the lower section 22L is also formed or supports a flared or funnel-shaped guide 26 so that the upper section 22*u* will be guided back into engagement with the lower section 22L after separation effected by the wearer. The vertical height of the guide 26 is dependent on the weight of the outer shell 12.

In some uses it may be preferable that the upper portion 22 not be tightly connected to the lower portion 27, to enable the outer shell 12 to wobble in accordance with the side-to-side or forward and back body movement of the wearer. Variations in the length of the two portions 22 and 27 of the vertical support 20, as well as the two sections 22*u* and 22L of the upper portion 22 will also affect the amount of effort required by the wearer to cause the head ornamentation 10 to wobble, as well as accommodating different size ornamentation to be created on the outer shell 12.

Figure 6:
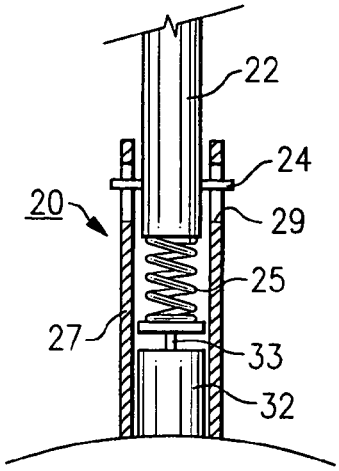
FIG. 6 is an enlarged view of an alternative base portion of a mechanism used in a second embodiment of the invention to effect relative vertical movement between the head ornamentation and the wearer to effect the same movement as the embodiment illustrated in FIG. 1 through the use of a solenoid-actuated spring mechanism.
Figure 7:
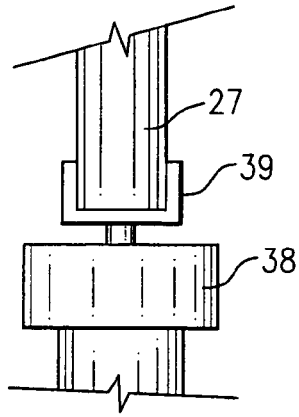
FIG. 7 is an enlarged view of another alternative mechanism for use in another embodiment of the invention to effect the same relative rotational movement between the head ornamentation and the wearer as that illustrated with reference to the embodiment of the invention illustrated in FIG. 1 through the use of a small electric motor having an integrated gear-box.

In another version of the invention as illustrated in FIGS. 6 and 7, a supplemental mechanism is utilized to create or augment the movement of the mask outer shell 12. In FIG. 6 a solenoid 32 is positioned between the compression spring 25 and the bottom of the lower portion 27 of the vertical support 20. In this manner, when a wearer actuates the solenoid 32, the plunger 33 thereof will drive against the spring 25 effecting a "pop up" of the outer shell 12.

In the embodiment of the invention illustrated in FIG. 7, a small electric motor 38, such as a reversible battery powered motor, having an integrated gear box is supported on the distal end of the lower portion 27 of the vertical support 20. A drive coupling 39 of the motor 30 is operatively connected to effect rotational movement of the outer shell 12 under the control of the wearer.

Figure 8:
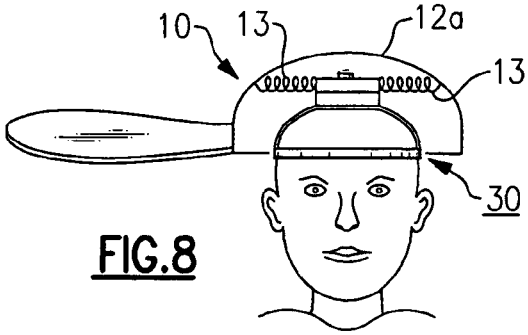
FIG. 8 is a frontal view of a further embodiment of the invention positioned on a wearer with portions broken away to better illustrate the internal mechanism which effects the relative vertical and rotational movements between the head ornamentation and the wearer.

As illustrated in FIG. 8, some applications of this technology will require that the distance between the top of the wearer's head and the top of the inside surface of the head ornamentation 10 such as when utilizing ornamentation such as a baseball type cap 12*a*, will be minimized without losing the desired bobbing, wobbling and rotational movements. In these instances the outer shell ornamentation 12*a* can be attached to the support adjustable cap or straps 30 with the use of elastic material such as rubber bands, small springs, a flexible membrane, or flexible supports 13 attached between the interior of the outer shell 12, and the cap or head straps 30.

Figure 9:
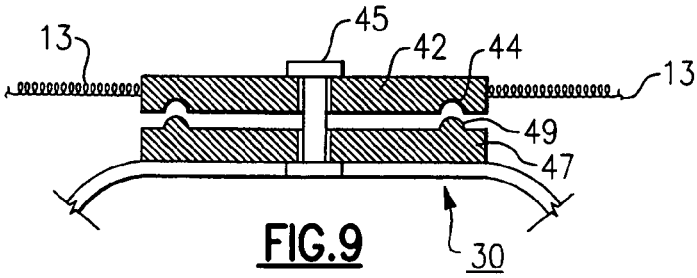
FIG. 9 is an enlarged view of portions of the mechanism used in the embodiment illustrated in FIG. 8 to effect the relative vertical side to side and rotational movements between the head ornamentation and the wearer.

As illustrated in FIG. 9 the rotational motion of the outer shell 12*a* can be obtained through the interface of two plates 42 and 47 with the top plate 42 attached to the outer shell 12*a* and the bottom plate 47 attached to the adjustable strap or cap 30 that hold the entire head ornamentation 10 on the wearer's head. One of these two plates will be formed with convex protrusions 49 and the adjoining plate will have corresponding concave 44 indentations. In this manner the engagement of the protrusions 49 and indentations 42 will prevent the outer shell 12*a* from turning until acted upon by movement of the wearer. By body movement the wearer can cause the ornamentation to bob upward by causing the engaged indentations 44 and protrusions 49 to move out from engagement with each other, while turning the head or body relative to the outer shell 12*a* thereby effecting a rotational movement between the wearer's body and the outer shell 12*a*. The number, shape and placement of the meshing protrusions 49 and indentations 44 can be varied to change the amount of effort required to implement rotation and effect the speed and distance of the rotation. A coupling pin 45 holds the plates 42 and 47 together while being sized to permit the two plates to rotate relative to each other when the protrusion and indentation are disengaged by the wearer.

Figure 10:
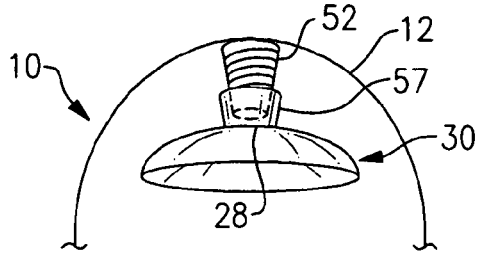
FIG. 10 is yet another alternative mechanism for effecting the rotation, bobbing and/or wobbling action of the head ornamentation worn on a user's head.

FIG. 10 illustrates a basic and simplified application of this invention. A cone-shaped support 57 of suitable material such as plastic is attached to the cap or head strap 30, and a cone-shaped spring 52 is attached to the outer shell 12. A small end of the cone-shaped spring 52 fits into the cone-shaped support cup 57 attached to the wearer's cap or adjustable straps 30. The interface of the spring 52 and the cup 57 may contain teeth 28 as described earlier to facilitate the rotational motion of the outer shell. The cone-shaped cup 57 is larger than the cone-shaped spring or support 52 thus facilitating wobbling of the outer shell. The use of a cone-shaped spring will facilitate the bobbing action. One, two or all three of the desired motions may be obtained by including or excluding the design features described above.

While this invention has been described in the specification and illustrated in the drawings with reference to preferred embodiments, the structures of which have been disclosed herein, it will be understood by those skilled in the art to which this invention pertains that various changes may be made and equivalents may be substituted for elements of the invention without departing from the scope of the claims. Therefore, it is intended that the invention not be limited to the particular embodiments disclosed in the specification and shown in the drawings as the best modes presently known by the inventor for carrying out this invention, nor confined to the details set forth, but that the invention will include all embodiments, modifications and changes as may come within the scope of the following claims.

This application was prepared without reference to any particular dictionary. Accordingly, the definition of the terms used herein conforms to the meaning intended by the inventor acting as his own lexicographer, in accordance with the teaching of the application, rather that any dictionary meaning which is contrary to or different from the inventor's meaning regardless of the authoritativeness of such dictionary.

What is claimed is:

1. An improved ornamentation such as a mask, cap, hat or headdress construction wherein an outer shell having an ornamental display is supported upon a portion of the body of a wearer for movement relative thereto, comprising:

an outer shell having an outer surface forming an ornamentation to be displayed, and having an opening into the interior thereof for receiving a portion of the body of a wearer upon which said outer shell is to be supported;

a vertical support means for effecting movement of said outer shell relative to the wearer;

said vertical support means having a lower portion adapted to be supported by the portion of a wearer's body received through said outer shell opening, and a upper portion operatively connected to said outer shell interior;

spring means operatively connected to said upper portion of said vertical support means and to said outer shell interior;

shaft means extending coaxially through said upper portion and said lower portion of said vertical support means for limiting the vertical movement and facilitating the rotational movement between said upper and lower portions; and drive means selectively and releasably connecting said upper portion to said lower portion for imparting a rotational movement to said upper portion of said vertical support means in response to the movement of said lower portion supported by the portion of a wearer's body received through said outer shell opening.

2. The apparatus of claim 1 wherein:

said upper portion of said vertical support means carries at least one recess adapted to be engaged by a complementary protrusion carried by said lower portion of said vertical support means; and said lower portion of said vertical support means carries at least one protrusion complementary to said at least one recess carried by said upper portion of said vertical support means.

3. The apparatus of claim 2 wherein said upper portion of said vertical support means is formed with a plurality of circumferentially spaced recesses and said lower portion of said vertical support means is formed with a plurality of circumferentially spaced protrusion complementary to said recesses.

4. A head ornamentation, comprising:

an ornamental outer shell;

a head support configured for being disposed on a wearer's head in a fixed position relative to the wearer's head;

a first plate attached to said head support, wherein said first plate includes a plurality of spaced protrusions;

a second plate rotatably attached to said first plate about an axis of rotation, wherein said second plate includes a plurality of spaced indentations configured for receiving said protrusions, each of said protrusions receivable in and engageable with a corresponding one of said indentations, whereby rotation of said head support via rotation of the wearer's head creates a rotational force between said first plate and said second plate sufficient to move engaged protrusions and indentations out from engagement, thereby effecting a rotational movement between the wearer's head and said ornamental outer shell; and a flexible support extending from and connecting said second plate to said ornamental outer shell.

5. The head ornamentation of claim 4, wherein said flexible support extends outwardly from said second plate substantially perpendicular to the axis of rotation of said first and second plates.

6. The head ornamentation of claim 4, wherein said first and second plates are rotatably attached via a coupling pin, said coupling pin aligned with and defining the axis of rotation of said first and second plates.

7. The head ornamentation of claim 4, wherein the head ornamentation includes at least two of said flexible supports.

8. The head ornamentation of claim 7, wherein said flexible supports are selected from the group consisting of rubber bands, springs, and elastic strips.

9. The head ornamentation of claim 4, wherein said flexible support comprises a flexible membrane.

10. The head ornamentation of claim 4, where said head support comprises an adjustable cap.

11. The head ornamentation of claim 4, wherein said head support comprises adjustable straps for encircling the wearer's head.

* * * * *